United States Patent [19]

Walter

[11] 4,327,842

[45] May 4, 1982

[54] CONTAINER AND CLOSURE THEREFOR

[75] Inventor: John Walter, Evergreen Park, Ill.

[73] Assignee: The Continental Group, Inc., New York, N.Y.

[21] Appl. No.: 191,227

[22] Filed: Sep. 26, 1980

[51] Int. Cl.[3] ..... B65D 51/16

[52] U.S. Cl. ..... 220/367; 220/307; 220/375; 215/237; 222/543

[58] Field of Search ..... 220/367, 307, 375, 94 A, 220/339; 215/237; 222/543, 481

[56] References Cited

U.S. PATENT DOCUMENTS

| | | | |
|---|---|---|---|
| 3,016,168 | 1/1962 | Larson | 222/189 |
| 3,021,976 | 2/1962 | Tracey | 220/66 |
| 3,049,264 | 8/1962 | Morawski | 220/306 |
| 3,415,412 | 12/1968 | Robinson | 220/270 |
| 3,532,248 | 10/1970 | Ruekberg | 220/270 |
| 3,744,662 | 7/1973 | Zundel | 220/270 |
| 3,794,207 | 2/1974 | Hunt | 220/269 |
| 3,949,897 | 4/1976 | Shaw'et al. | 220/367 X |
| 3,998,354 | 12/1976 | Song | 220/304 |
| 3,999,678 | 12/1976 | Ignell | 220/270 |
| 4,002,516 | 1/1977 | Gaborieau et al. | 220/307 X |
| 4,171,062 | 1/1979 | Allen | 220/367 |
| 4,220,249 | 8/1980 | Nilsson | 215/237 |

*Primary Examiner*—George T. Hall
*Attorney, Agent, or Firm*—Charles E. Brown

[57] ABSTRACT

A closure for a container having a neck portion, a plug which has a fluid-tight fit within the neck portion, and a manually openable pressure release valve associated with said plug operative upon being opened to release the pressure in the container and also to condition the plug for relatively easy withdrawal to open position.

12 Claims, 6 Drawing Figures

CONTAINER AND CLOSURE THEREFOR

BACKGROUND OF THE INVENTION

Containers of the type under consideration consist of a cylindrical body with either an integral or seamed bottom and having a domed upper end with a neck which is associated with a closure.

Various closures for the small diameter neck are available. Such closures are shown in U.S. Pat. Nos. 3,251,499, 3,317,070, 3,348,719, 3,998,354, 3,999,678, and 4,149,651.

DESCRIPTION OF THE PROBLEM

After considering various types of snap-in closures of the types heretofore discussed, a number of problems were noted. Some of the most objectionable problems have been the lack of consistent positive closure under pressure and which is also relatively easy to open and simple to adapt to high speed manufacture and application. Structures of the general type under consideration have been heretofore made, but are more bulky and costly and the best references require a closure which must be torn away from the plug. This type of structure requires extremely accurately machined dies and the section to be torn apart must be precisely dimensioned, not only to withhold the pressure but also be capable of rupturing when being tensioned by the pulling effort exerted by the person wanting to open the closure.

SOLUTION OF THE PROBLEM

The snap-close closure of the instant invention has been made not only to minimize the amount of material used but also provides a novel combined venting and opening-facilitating structure which enhances the integrity of the seal. This structure is obtained by placing the venting mechanism in a position wherein when the parts are interlocked in closing position, they supplement the closure function and when these parts are separated to vent, the closure portion is unsupported in the area of initial separation and thus is more flexible in this area and readily deflects to release the interlocking parts whereby facilitating opening of the closure.

SUMMARY OF THE INVENTION

This invention is directed to closures and, more particularly, to closures for pressurized products.

A main object of the invention is to provide a closure which may be easily inserted into the open end of a container and in which parts in closed position are interrelated to maintain the closure from opening or leaking and upon certain parts being separated during the opening sequence, the container is first vented and other parts are rendered more susceptible to opening.

A further object is to provide a novel closure having several parts tethered to each other and which are reclosable.

Another object is to provide a plastic closure which is made as a single unit in a simple molding operation.

These and other objects inherent in and encompassed by the invention will become more apparent from the specification and the drawings wherein.

DESCRIPTION OF THE INVENTION

Figure 1:
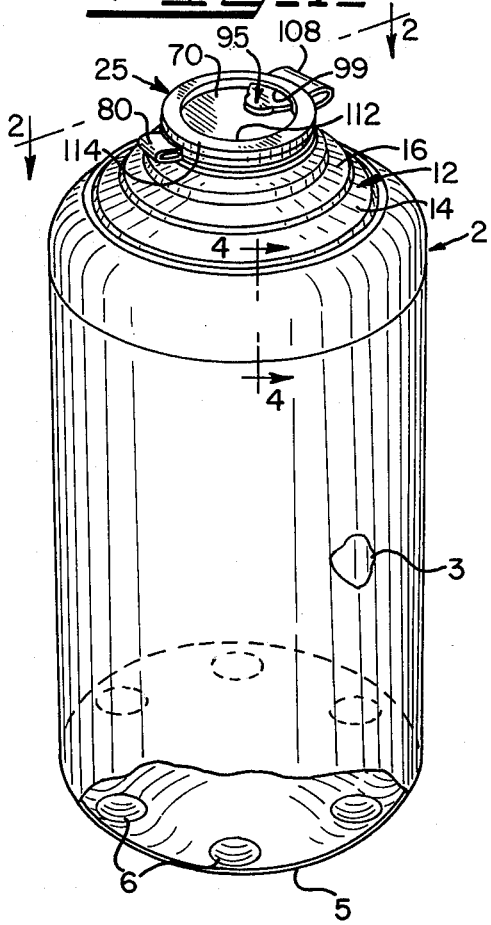
FIG. 1 is a perspective view of the novel container incorporating the invention.
Figure 2:
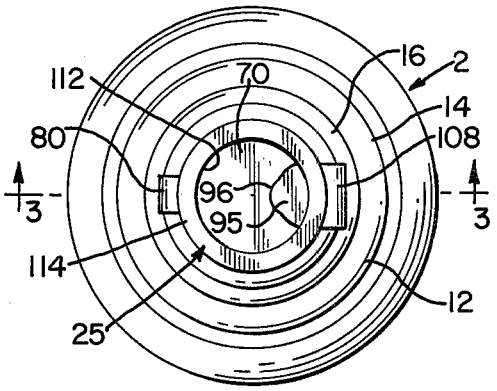
FIG. 2 is a top plan view thereof taken on line 2—2 of FIG. 1, fragmentary.
Figure 4:
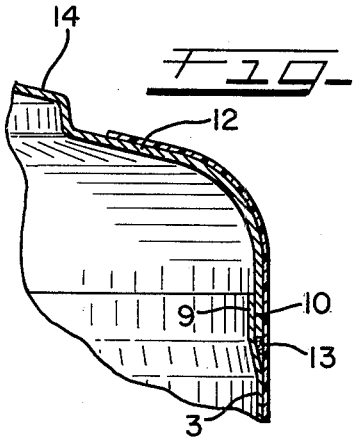
FIG. 4 is a fragmentary enlarged sectional view taken substantially on line 4—4 of FIG. 1.

The invention is shown incorporated in a container 2 made of metal such as aluminum and comprises a cylindrical body 3 with an integral outwardly convexed bottom 5 which is provided with outwardly protruding dimples 6 upon which the container rests.

The upper open end portion 8 of the body portion is necked in at 9 and fits into an annular skirt portion 10 of a dome member 12 which forms the upper end of the container. A suitable adhesive 13 bonds the portion 8 to the skirt 10. The dome portion has a series of stepped annular sections 14 and 16 and at its uppermost end is formed with an inturned frusto-conical lip 18 converging inwardly and providing a sharp closure-retaining edge 20 and defining the pour opening 22 at the upper end of the container.

A plastic closure 25 is provided at the upper end of the container and comprises a neck portion 26, a closure plug portion 28 and a venting portion 30 to which is attached a finger grip or handle 32.

The neck portion 26 is a cylindrical member which at its lower end 34 is tapered at 36 and is tightly wedged through the opening 22 and then expands radially outwardly and engages its shoulder 38 under the edge 20 of the lip 18.

The neck 26 has a pair of axially spaced sealing rings 40, 42, triangular shaped in cross section tightly pressed at their apices 44, 46 against the frusto-conical external surface 45 of the lip 18 to provide a fluid-tight pressure seal.

The interior bore surface 50 of the neck portion is provided with a locking ring member or shoulder 52 which has a downwardly sloping upper surface 56 merging into an apical edge 58 with a bottom locking surface 60 which extends normal to the axis of the neck portion. Above the ring 52 the bore surface is of frusto-conical shape which widens toward the upper end to facilitate entry of the lower end portion 62 of the closure plug 28. The plug 28 has a cylindrical side wall 65 which intermediate its upper and lower edges is provided with an annular locking ring or rib 66 which is of triangular cross-section having a lower downwardly tapered pilot surface 67 which is adapted to be guided upon engagement with the upper similarly tapered face 56 of the neck locking ring past the apex 58 when the cap is pressed into the neck opening or bore 50 whereupon an apical edge 68 is deflected with edge 58 and the locking ring or shoulder 66 on the cap is stepped under the shoulder 52 of the neck and a flat radially outwardly extending surface 69 at the upper end of the shoulder 66, normal to the axis of the neck, locks under the face 60.

The cap has a top wall 70 integral with the upper end of the plug 64 and wall 70 has a peripheral portion 72 extending beyond the perimeter of the plug. The portion 72 is annular and has a rib 74 on its underside pressed, in the closed position, against the top surface 75 of an annular flange 76 integral with and extending radially outwardly from the upper end of the neck portion 26. The bottom side 77 of flange 75 presses against the crest of an annular U-shaped ridge 78 formed at the juncture of the dome wall 79 and the lip 18.

A tether in the form of a narrow strap 80 connects a peripheral edge portion 81 of flange 72 with a peripheral edge portion 82 of the top wall 70 of the cap.

The cap is provided with a vent opening 84 in an area diametrically opposite to the tether 80 close to the plug adjacent to its interior surface and the vent opening 84 is coaxial with a depending hollow tubular extension 85 formed on the underside of the top wall of the cap.

A frusto-conical pilot cavity 86 is formed at the upper end of opening 84 for guiding an enlarged head 88 of a pin or male closure element 89. The head has a downwardly taped peripheral surface 90 which at its upper end has an annular shoulder 92 which in the closed position engages under a lower complimentary lower edge 93 on the bottom end of the tubular extension 85.

The upper end of the vent pin 89 depends from and is integrally connected with a lever lug 95 intermediate its ends, the lever 95 has an inner fulcrum end 96 which engages with the top side 97 of the top wall 70 radially inwardly of the vent opening. The other end 98 of the lever 95 extends radially outwardly and is connected to the inner periphery 99 of a lift ring 32 which in the closed position of the closure lies flat with its lower side 102 against the flat upper face 97 of the cap top wall 70. The ring has its outer periphery 106 connected to one end of a narrow strap 108 which is folded and which has its other end 109 connected to the outer edge of wall 70 in an area diametrically opposite the strap 80.

Figure 3:
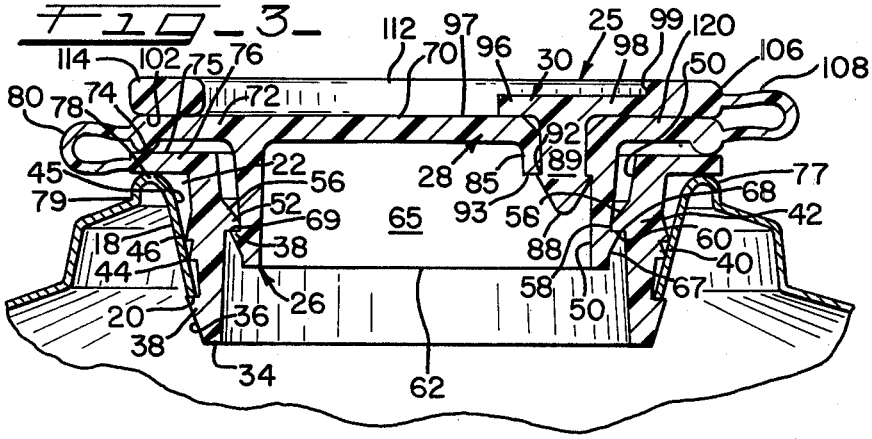
FIG. 3 is an enlarged cross sectional view taken substantially on line 3—3 of FIG. 2.
Figure 5:
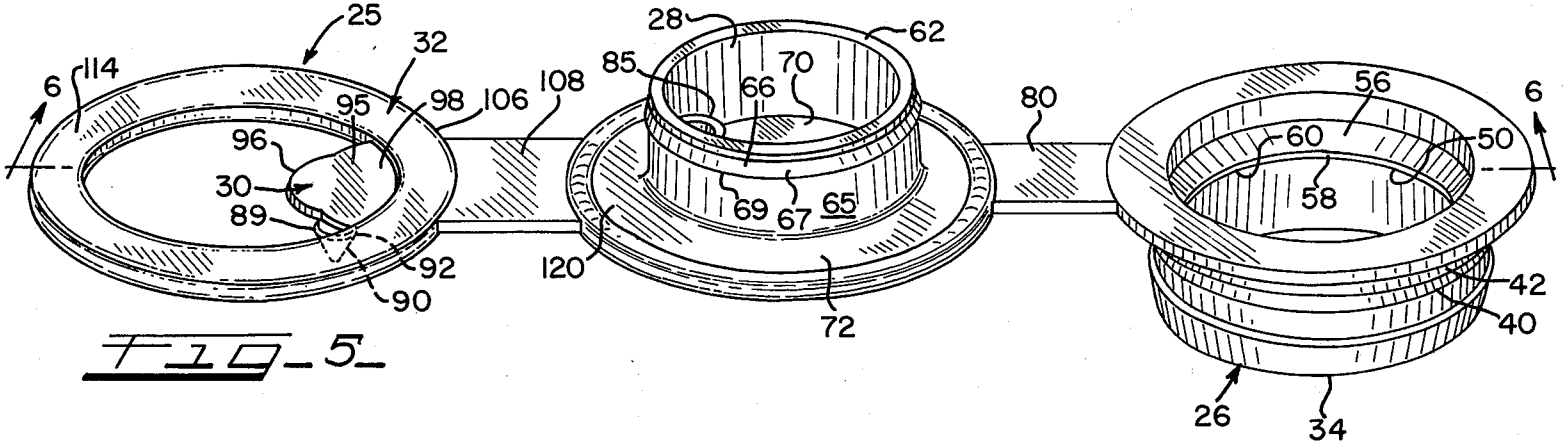
FIG. 5 is an enlarged perspective view of the closure structure.
Figure 6:
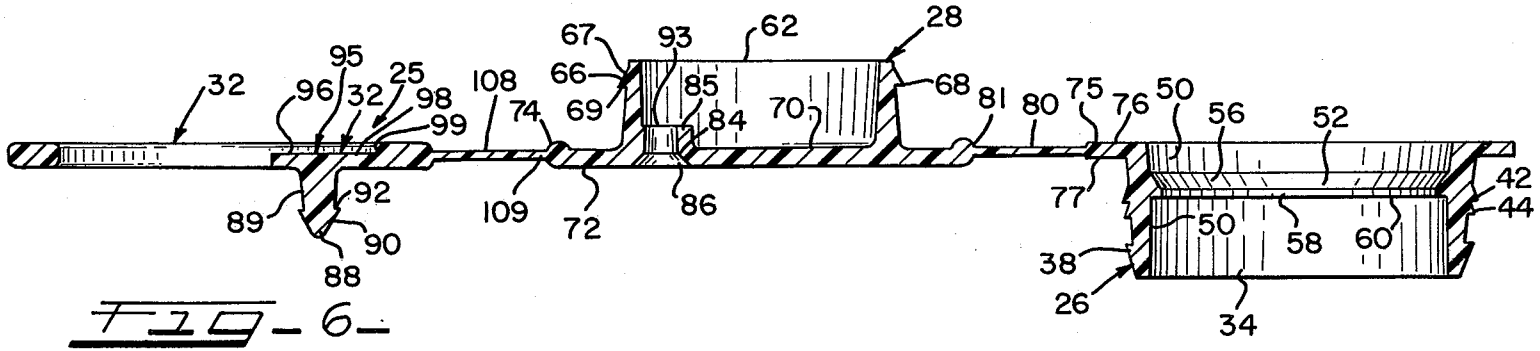
FIG. 6 is a cross-sectional view taken on line 6—6 of FIG. 5.

Thus, to open the closure shown closed in FIG. 3, the user inserts his finger through the ring hole 112 and lifts on portion 114 diametrically opposite the lever 95 thus lifting the end portion 98 upwardly and fulcruming the inner end 96 against the top wall 70 of the cap. A second class lever action obtains and the vent closure pin 89 is lifted out of the vent opening 84 attendant to slight deformation of the head. Removal of the pin 89 removes the support for the plug wall in the immediate area and thus enhances the flexure of the portion of the neck wall in the region of the vent opening whereby as the ring is further lifted, it pulls on the tether 108 which, in turn, curls the portion 120 of the top wall 70 upwardly and causes the adjacent portion of the wall 70 contiguous to the vent opening to warp radially inwardly thus facilitating partially unhooking of the ledge or shoulder 66 from under the shoulder 52 and disengaging the locking face 69 from face 60. The plug then easily lifts out of the neck opening and with the handle portion lays to one side of the pour opening the neck.

To reclose the closure, the plug of the cap is pressed into the neck opening until the shoulder 52 snaps under the shoulder 66. Then the handle is folded over the cap and the vent plug or pin 89 is pressed into the vent opening until the shoulder 92 snaps under the lower edge 93 of the vent tube.

What is claimed is:

1. A closure for a container having a neck part and a closure part including a plastic deflectable plug part insertable in said neck part for closing a pour opening in the neck part, and a vent assembly, said vent assembly in the closed position rigidifying said plug part to resist removal thereof from the neck part, said vent assembly including separable parts attendant on separation to open said vent assembly preparatory to opening of said closure for accommodating flexure of said plug part and thus facilitating release of the plug part from the neck part.

2. The invention according to claim 1 and pull tab means connected to said closure in the region of said vent assembly for deforming said plug part upon said tab means being pulled and thus facilitating removal of said plug part from said neck part.

3. The invention according to claim 1 and said closure having a handle means, lever means connected to a first separable part and said handle means and reactively abuttable against said neck part upon being pulled by said handle means to dislodge said first separable part.

4. The invention according to claim 1 and said closure having handle means overlaid with respect to said closure part and operatively connected with one of said separable parts and said closure part for sequentially dislodging said separable part and thereafter said closure part.

5. The invention according to claim 3 and said lever means arranged to operate as a second class lever.

6. A closure for a pressurized beverage container having an open end, a plastic neck member inserted into said opening in sealed tight fit therein and having a bore with an annular shoulder therein, a plastic closure member having a top wall and a hollow plug depending therefrom with an annular shoulder thereabout adapted to be pressed under said shoulder on said neck member, said top wall having vent means comprising a vent opening therein extending alongside a section of the interior of the plug, a male element extending in sealing position through said vent opening and having a lower end with a shoulder thereabout seated against the underside of said vent means and abutting against said section of the plug in buttressing relation thereto against lateral deflection, means for withdrawing said male element from said vent opening and thereby venting said container and enhancing flexure of said plug section, and means for flexing said plug section upon withdrawal of said male element for dislodging the plug from the neck element by disengaging the shoulder on the plug from that on the neck member.

7. The invention according to claim 6 wherein said means for dislodging the plug comprises a lever element tethered at one end to a peripheral edge of the top wall and a handle connected to one end of the lever, said lever being connected intermediate its end to said male element and having a second end abuttable against said top wall for fulcruming thereon.

8. The invention according to claim 7 and said neck member having axially spaced external annular shoulders, and said container having about said open end a frusto-conical lip portion including a lower edge sealingly bearing against one of said external shoulders and presenting an internal frusto-conical surface sealingly engaged with another of said external shoulders.

9. The invention according to claim 8 and said lip portion having a convex juncture with a portion of the container thereabout, and said top wall bearing against said juncture.

10. In a container having a neck member with an internal annular shoulder, a closure member having a plug fitted within the neck member and said plug having an external annular shoulder, said shoulders being deflectable in closing and opening of the container, means for inhibiting deflection of said one member in a preselected region, and means for displacing said last-mentioned means for reducing the resistance to deflection of said one member in said region, and attendant to deflection of said one member, removal of said plug.

11. An easy opening plastic closure for a container, said closure comprising an attachment member adapted to be attached to the container, a plug insertable into an opening in said attachment member for closing said opening and said plug being removable from said opening to open the same, an opening member connected to said plug operable to withdraw the plug from said opening, a vent assembly comprising an aperture in said plug for communicating with the interior of the container in the closed position of said plug and a male member connected to said member opening withdrawable from said aperture for venting attendant to operation of said opening member.

12. An easy opening molded plastic closure for a container, said closure comprising an attachment member adapted to be attached to the container and having an aperture therein, a plug insertable into the aperture for closing the same and withdrawable from the aperture for the opening of same, an element connected to said plug having means reactive against said attachment member for prying the plug out of said opening aperture, means hingedly connecting said element to said plug and means hingedly connecting said plug to said attachment member.

* * * * *